US009039540B2

(12) United States Patent
Kuempel

(10) Patent No.: US 9,039,540 B2
(45) Date of Patent: May 26, 2015

(54) RACECOURSE SYSTEM AND METHODS THEREOF

(76) Inventor: Brian Kuempel, Pflugerville, TX (US)

( * ) Notice: Subject to any disclaimer, the term of this patent is extended or adjusted under 35 U.S.C. 154(b) by 190 days.

(21) Appl. No.: 13/161,429

(22) Filed: Jun. 15, 2011

(65) Prior Publication Data

US 2011/0312429 A1 Dec. 22, 2011

Related U.S. Application Data

(60) Provisional application No. 61/355,267, filed on Jun. 16, 2010.

(51) Int. Cl.

| | |
|---|---|
| ***A63K 1/00*** | (2006.01) |
| ***A63H 18/02*** | (2006.01) |
| *A63G 27/00* | (2006.01) |

(52) U.S. Cl.
CPC . *A63H 18/02* (2013.01); *A63K 1/00* (2013.01)

(58) Field of Classification Search
USPC ..... 472/3, 85–94, 117; 446/431, 444
See application file for complete search history.

(56) References Cited

U.S. PATENT DOCUMENTS

| | | | | |
|---|---|---|---|---|
| 3,810,706 | A * | 5/1974 | Grimm et al. | 404/1 |
| 5,061,211 | A * | 10/1991 | Barber | 440/37 |
| 5,676,601 | A * | 10/1997 | Saunders | 472/29 |
| 5,738,588 | A * | 4/1998 | Esser | 472/92 |
| 7,651,398 | B2 * | 1/2010 | Ostendorff et al. | 463/60 |
| 7,892,068 | B2 * | 2/2011 | Nuttall et al. | 446/444 |
| 7,951,011 | B2 * | 5/2011 | Lochtefeld | 472/117 |

* cited by examiner

*Primary Examiner* — Kien Nguyen
(74) *Attorney, Agent, or Firm* — The Law Offices of Eric W. Peterson

(57) ABSTRACT

A race course system for operating scale vehicles having a race course section having a race course portion, a base support, a hinge, a portable member, an attachment member, a strut mechanism, and a console.

15 Claims, 5 Drawing Sheets

RACECOURSE SYSTEM AND METHODS THEREOF

CROSS-REFERENCE TO RELATED APPLICATION

This application claims the benefit of priority to U.S. Provisional Application No. 61/355,267 filed on Jun. 16, 2010, which is incorporated herein by reference in its entirety.

BACKGROUND

Racing remote control cars has been a popular hobby for people of all ages for many years. Children and adults are captivated by the opportunity to control vehicles that normally are not available for use. Racing events are usually sponsored by a hobby shop or a race car club and held at the hobby shop's parking lot or abandoned field. Typically, a temporary race course is constructed on the parking lot or field and vehicles are raced thereon. The race course is typically constructed of sections to allow the race course to be transported more conveniently.

SUMMARY

The present disclosure pertains to a race course system for operating scaled vehicles. In one embodiment, the system has a race course section having a race course portion, a base support, a hinge, and a portable member, wherein the race course portion engages the base support by way of the hinge and the base support engages the portable member. In one embodiment, the race course portion has a surface, a race surface frame, and a boundary, wherein the boundary engages the race surface frame and the surface engages the race surface frame. In one embodiment, the race surface frame has an interior frame member, exterior frame member, end frame member, and brace frame member. In one embodiment, the boundary has an exterior guard and a guard support, wherein the exterior guard engages the guard support. In one embodiment, the guard support has an absorption member. In one embodiment, the base support has base support frame, a race course portion support, an interior guard frame, an interior guard support, and a cavity, wherein the base support frame engages the race course portion support, the interior guard supports engage the base support frame and the interior guard frame, and the cavity allows the race course portion to be stowed. In one embodiment, the base support has an adjustable system. In one embodiment, the portable member has a mounting plate and a caster. In one embodiment, the race course section has an interior guard. In one embodiment, the system has an attachment member. In one embodiment, the system has a strut mechanism. In one embodiment, the system has a console.

In one embodiment, the method of operating a race course system has the steps of providing a race course section having a race course portion, a base support, a hinge, and a portable member, unfolding the race course portion from the base support thereby allowing the race course portion to rotate around the hinge and resting in a substantially horizontal plane, attaching a first race course portion to a second race course portion using an attachment member, and attaching a first race course section to a second race course section using an attachment member.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

The present invention provides for a race course system 100. The race course system 100 provides for a race course 110 that allows for various vehicles or objects to travel within the perimeter of the race course 110, for example, without limitation, scale vehicle, scale radio controlled vehicles, scale radio controlled automobiles, scale radio controlled trucks, scaled radio control boats, slot cars, or the like. The race course 110 can be various shapes, for example, without limitation, a square, rectangle, circle, ellipse, rectangle with tapered corners, square with tapered corners, or the like.

Figure 1:
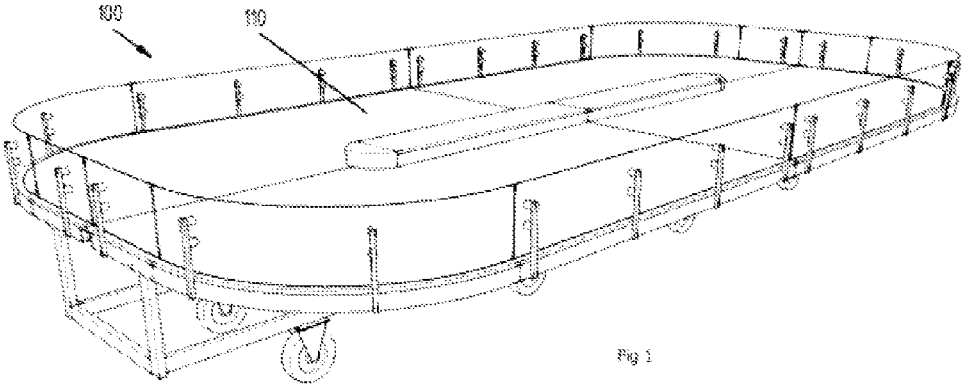
FIG. 1 is an elevated view of the portable race course system according to an exemplary embodiment of the present invention.
Figure 2:
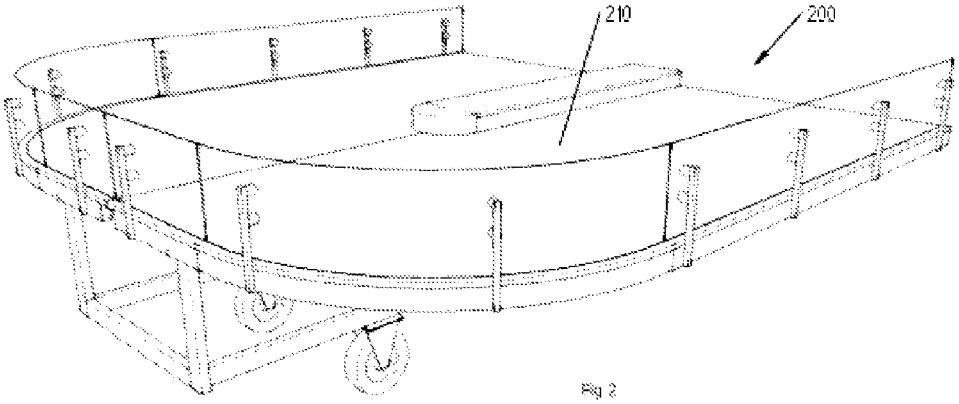
FIG. 2 is an elevated view of the race course section according to an exemplary embodiment of the present invention.

The race course system 100 can have a plurality of race course sections 200 configured and designed to provide a race course 110. As shown in FIG. 1, in the preferred embodiment, two mirroring race course sections 200 form the race course 110. In this embodiment, the race course section 200 is in the shape of a half rectangle with two tapered corners, however, the race course section 200 can be any shape, for example, without limitation, a half circle, a rectangle, a square, a half rectangle with tapered corners, a half square with tapered corners, or the like. In another embodiment, the race course 110 can have three race course sections 200 where the end race course sections 200 are half rectangles with two tapered corners and the middle race course section 200 is a rectangle thereby extending the length of the race course 110. In such an embodiment, any number of rectangle race course sections 200 can be added to extend the length of the race course 110.

The race course section 200 can have a plurality of race course portions 210. As shown in FIG. 1, in the preferred embodiment, two mirroring race course portions 210 form a race course section 200. In the preferred embodiment, the race course portion 210 is in the shape of a rectangle with one tapered corner, however, the race course section 200 can be any shape, for example, without limitation, a quarter circle, a half rectangle, a half square, a quarter rectangle with one tapered corner, a quarter square with one tapered corner, or the like. The width and length of the race course portion 210 can be any dimensions that provide for a race course 110 and preferably 4' and 8', respectively.

Figure 3:
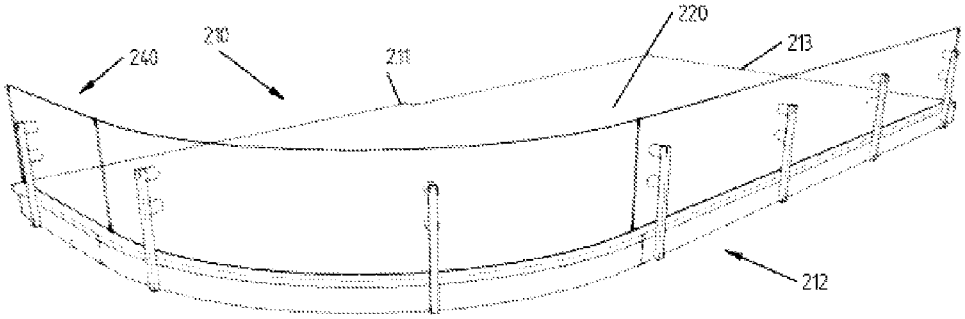
FIG. 3 is an elevated view of the race course portion according to an exemplary embodiment of the present invention.
Figure 4:
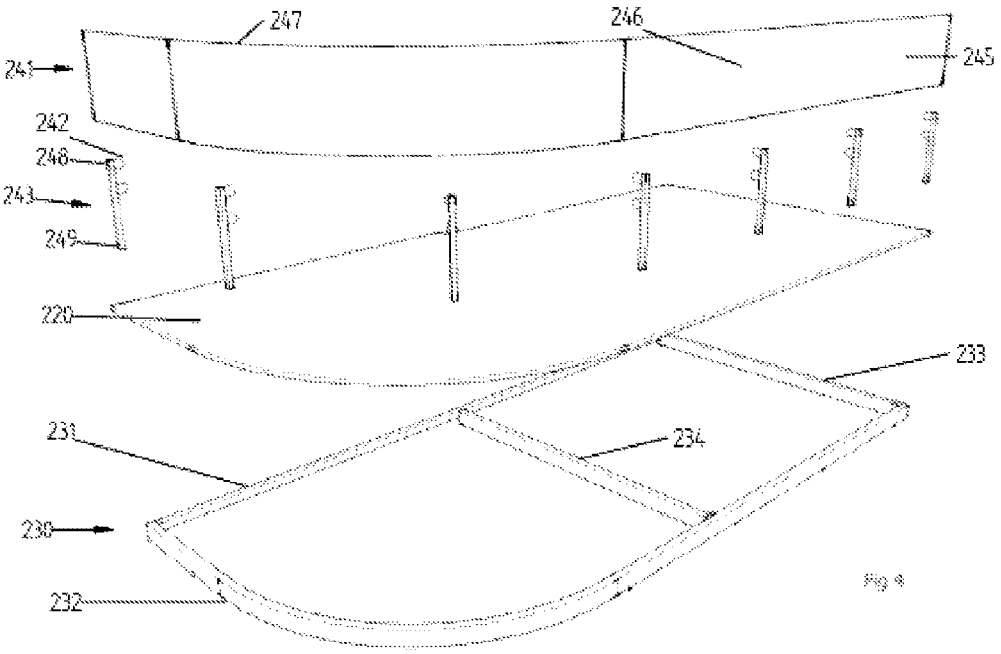
FIG. 4 is an elevated exploded view of the race course portion according to an exemplary embodiment of the present invention.

As shown in FIGS. 3 and 4, in the preferred embodiment, the race course portion 210 has an interior side 211, an exterior side 212, an end 213, a surface 220, and a race surface frame 230. The surface 220 can be substantially flat, banked, or possess various changes in the contour of the surface 220, for example, without limitation, raises, dips, bridges, overpasses, underpasses, bumps, jumps, impassable guards, or the like. The surface 220 may comprise any rigid supportive material, for example, without limitation, wood, metal, plastic, or the like. It may comprise a textured surface 220 such as carpet or rubber to add a non-skid element. The surface 220 can be any of the shapes used to describe the race course portion 210. In the preferred embodiment, the surface 220 is a rectangle with one tapered corner to coincide with the shape of the race course portion 210.

The race surface frame 230 can be any assembly that provides support for the surface 220. As shown in FIG. 4, in the preferred embodiment, the race surface frame 230 has an interior frame member 231, an exterior frame member 232, an end frame member 233, and a brace frame member 234. The brace frame member 234 is configured and designed to maintain a fixed relationship between the interior frame member 231 and the exterior frame member 232. The exterior frame member 232 can be shaped to match the shape of the surface 220. The exterior frame member 232, interior frame member 231, end frame member 233, and brace frame member 234 are substantially perpendicularly connected end to end within a substantially horizontal plane. The resulting race surface frame 230 can be any of the shapes used to describe the race course portion 210.

The race surface frame 230 can comprise any conventional material including wood, metal, plastic, or the like. In the preferred embodiment, the race surface frame 230 is made of thin metal rods or tubing having a rectangular cross section. In another embodiment, the race surface frame 230 can be made of rods or tubing having an oval, circular, or hexagonal cross section. The surface 220 connects to the top surface of the race surface frame 230 in a position with edges aligned. The race surface frame 230 connects to the surface 220 by any conventional means of connecting two members, for example, without limitation, nailing, screwing, gluing, welding, bolting, or the like. The interior frame member 231, exterior frame member 232, end frame member 233, and brace frame member 234 can be connected by any conventional means of connecting two members, for example, without limitation, nailing, screwing, gluing, welding, bolting, or the like.

In the preferred embodiment, the race course portion 210 has a boundary 240. The boundary 240 is configured and designed to retain the vehicles or objects within the race course 110. The boundary 240 can have an exterior guard 241 and a guard support 243.

The exterior guard 241 is a siding configured and designed to provide retention of the vehicles or objects that travel within the perimeter of the race course 110. The exterior guard 241 has an exterior side 245, an interior side 246, and a ridge 247. The exterior guard 241 may be substantially vertical or may be inclined slightly, such as between 0° and 10° relative to a vertical plane. The exterior guard 241 can be positioned to bend along the exterior perimeter of the race course portion 210. The exterior guard 241 can be transparent or opaque, but is preferably transparent. The exterior guard 241 may comprise any flexible material known in the art, for example, without limitation, lexan, plastic, acrylic, wood, metal, or the like. The exterior guard 241 is sized to accommodate the exterior perimeter of the race course 110. The exterior guard 241 can have any height that retains the vehicles and objects that travel within the perimeter of the race course 110. The exterior guard 241 preferably has a height of 10".

The boundary 240 engages the race surface frame 230 by way of the guard support 243. The guard support 243 provides support to the exterior guard 241. The guard support 243 has a top 248 and a base 249. The guard support 243 engages the exterior guard 241 and the race course portion 210. The guard support 243 can engage the exterior guard 241 and the race course portion 210 at any position that allows the exterior guard 241 to provide retention of the vehicles or objects operated within the perimeter of the race course 110. In the preferred embodiment, the top 248 of the guard support 243 engages the exterior guard 241 at the exterior side 245 and the base 249 of the guard support 243 engages the race course portion 210 at the race surface frame 230. The guard support 243 engages the race course portion 210 substantially perpendicular to the horizontal plane of the race course portion 210. The guard support 243 may be substantially vertical or may be inclined slightly, such as between 0° and 10° relative to a vertical plane. In the preferred embodiment, the guard support 243 is inclined at 0° relative to a vertical plane. The guard support 243 may comprise any rigid material, for example, without limitation, wood, metal, plastic, or the like. The guard support 243 is preferably shaped as long, thin rods having a rectangular cross section, but could take any other shape, such as rods having an oval, circular, or hexagonal cross section. The guard support 243 can be any length that supports the exterior guard 241, but preferably has a length of 9½". Any number of guard supports 243 can engage the race course portion 210. In the preferred embodiment, seven evenly spaced guard supports 243 line the exterior perimeter of the race course portion 210.

In the preferred embodiment, the guard support 243 can have an absorption member 242 configured to absorb the impact of vehicles or objects with the boundary that travel within the perimeter of the race course 110. The absorption member 242 can be any means of absorbing energy, for example, without limitation, a bumper, a spring, or the like. In one embodiment, the absorption member 242 engages the top of the guard support 243 and the exterior guard 241. A plurality of absorption members 242 can be used to absorb an impact. In the preferred embodiment, two absorption members 242 engage the guard support 243 and the exterior guard 241. In the preferred embodiment, the absorption member 242 is a bumper. The bumper may comprise any soft material known in the art, including but not limited to rubber, gel, foam, or the like. The bumper is preferably shaped as a short, thin cylinder having a circular cross section, but could take any other shape, such as rods having an oval, rectangle, hexagonal cross section, or the like. The bumper can be any length or width that allows for the absorption of energy. The bumper is preferably 1" long and 1" wide.

In another embodiment, the absorption member 242 is a spring incorporated into the base of the guard support 243. The spring can be any design that allows the guard support 243 to flex at an angle away from the vertical plane thereby absorbing the energy of the impact by an object with the exterior guard 241, for example, without limitation, a coiled spring, flexible plastic, a hinge, or the like.

Figure 10:
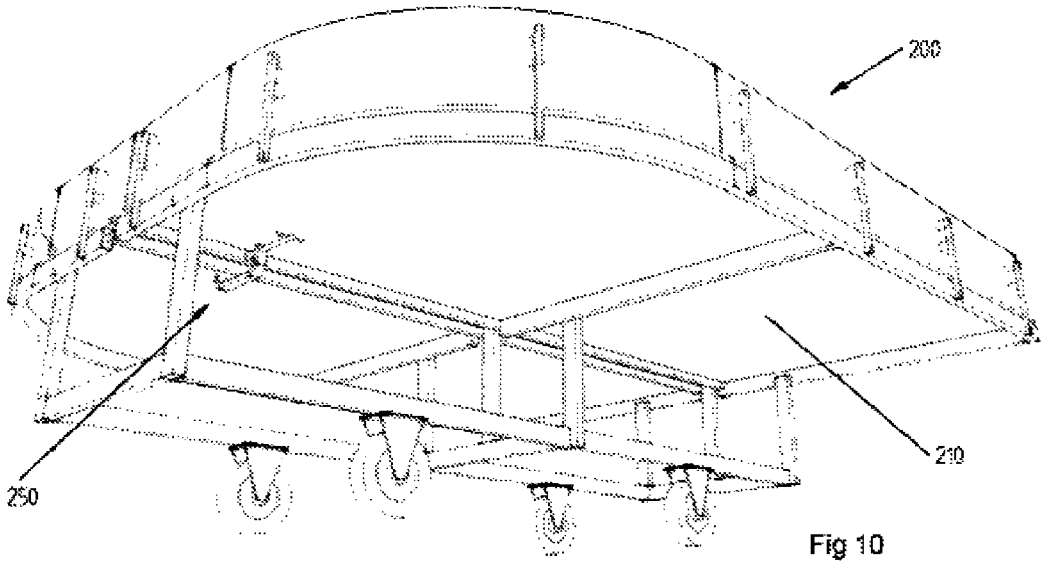
FIG. 10 is an underside view of the race course section according to an exemplary embodiment of the present invention.

In the preferred embodiment, the race course system 100 can have a plurality of attachment members 250 that allow one race course portion 210 to engage with another race course portion 210. As shown in FIG. 10, the attachment member 250 can be permanently affixed to the race surface frame 230 of the race course portion 210 wherein one part of the attachment member 250 is affixed to one race course portion 210 and the other part of the attachment member 250 is affixed to the other race course portion 210. The attachment member 250 can secure one end 213 of a race course portion 210 to the end 213 of another race course portion 210 and one interior side 211 of a race course portion 210 to the interior side 211 of another race course portion 210. In the alternative, the attachment member 250 can be temporarily engaged to the race course portions 210. The attachment member 250 can be any means of temporarily securing two race course portions 210 together wherein the attachment member 250 is positioned on the race surface frame 230 of each race course portion 210 thereby securing the race course portions 210 together when the attachment member 250 is tightened, for example, a clamp, a joint connector, a table top connector, or the like.

Figure 5:
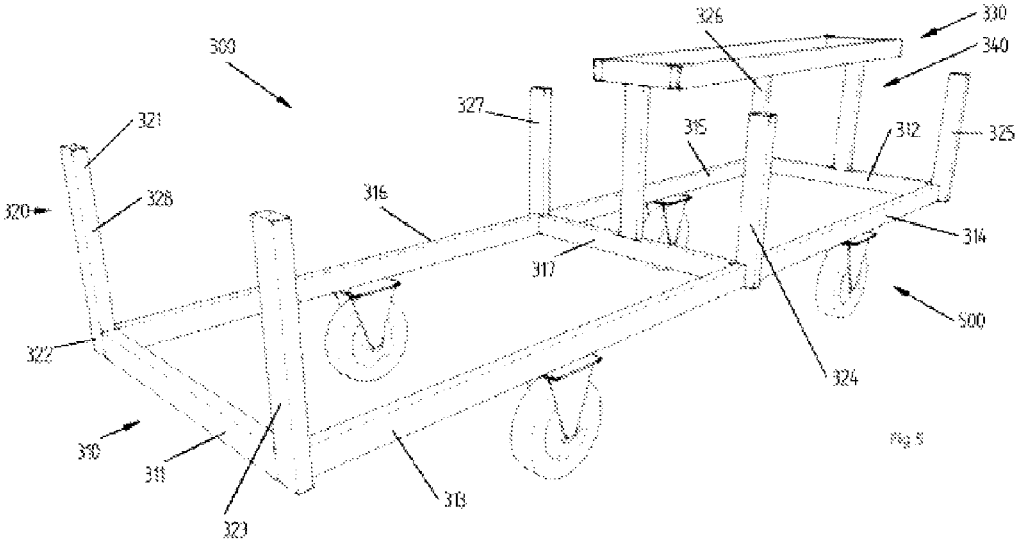
FIG. 5 is an elevated view of the base support according to an exemplary embodiment of the present invention.

In the preferred embodiment, the race course section 200 can also have a base support 300. The base support 300 allows for the race course portion 210 to be elevated to a desired height above the ground. As shown in FIG. 5, in the preferred embodiment, the base support 300 can have a base support frame 310, a plurality of race course portion supports 320, an interior guard frame 330, and a plurality of interior guard supports 340. The base support frame 310 provides the support for the elevation of the race course portion 210. The base support frame 310 can have end member 311, end member 312, side member 313, side member 314, side member 315, side member 316, and brace member 317. In the preferred embodiment, the end members 311, 312 and brace member 317 are positioned substantially parallel to each other and substantially perpendicular to side members 313, 314, 315, 316, while all seven members are positioned in a horizontal plane. The base support 300 can comprise any conventional material including wood, metal, plastic, or the like. In the preferred embodiment, the base support 300 is made of thin metal rods or tubing having a rectangular cross section. In another embodiment, the base support 300 can be made of rods or tubing having an oval, circular, or hexagonal cross section. The base support frame 310, race course portion supports 320, interior guard frame 330, and interior guard supports 340 can be connected by any conventional means of connecting two members, for example, without limitation, nailing, screwing, gluing, welding, bolting, or the like.

A plurality of race course portion supports 320 elevate the race course portion 210 above the ground. Each race course portion support 320 has a top 321 and base 322. The base 322 of the race course portion supports 320 engage the base support frame 310 substantially perpendicular to the horizontal plane of the base support frame 310 at any position on the base support 300. Any number of race course portion supports 320 can engage the base support 300 and the race course portion 210. As shown in FIG. 5, in the preferred embodiment, six race course portion supports 323, 324, 325, 326, 327, 328 engage the base support frame 310. In this embodiment, race course portion supports 323, 325, 326, 328 engaged the base support frame 310 at each corner of the base support frame 310, race course portion supports 324 engages the base support frame 310 between side members 313, 314, and race course portion supports 327 engages the base support frame 310 between side members 315, 316. The top 321 of the race course portion supports 320 can engage the race course portion 210 substantially perpendicular to the horizontal plane of the race course portion support 320 along any line running the length of the race course portion 210. The race course portion supports 320 can be any height that allows the race course portion 210 to be elevated. In the preferred embodiment, the race course portion supports 320 have a height of 15½".

Figure 6:
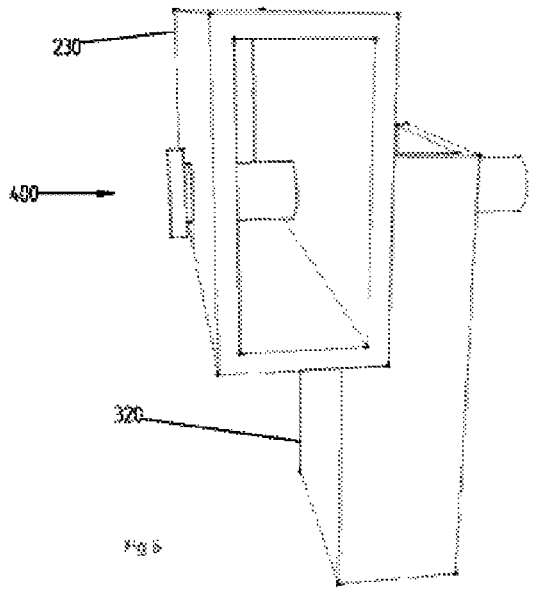
FIG. 6 is an elevated side view of the hinge according to an exemplary embodiment of the present invention.

In the preferred embodiment, the race course section 200 has a plurality of hinges 400 designed and configured to provide for a pivoting relationship between the race course portion 210 and the race course portion support 320. The race course portion 210 engages the race course portion support 320 by way of hinge 400. The hinge 400 can be any means that allows two members to be rotationally engaged, for example, without limitation, a bolt, a pin, a cotter pin, or the like. As shown in FIG. 6, in the preferred embodiment, the hinge 400 has a pin that passes through the race surface frame 230 and the race course portion support 320, thereby rotationally engaging the race surface frame 230 with the race course portion support 320. The hinge 400 may comprise any hard supportive material, for example, without limitation, wood, metal, plastic, or the like. The preferred embodiment has three hinges 400 per each race course portion 210 whereby three pins connect three race course portion supports 320 to a race course portion 210 at three positions on the race course portion 210, for example, without limitation, one pin rotationally engages a race course portion support 323 with exterior frame member 232, a second pin rotationally engages a race course portion support 324 with brace frame member 234, and a third pin rotationally engages a race course portion support 325 with end frame member 233. In the preferred embodiment, the distance from the interior side 211 to the hinges 400 is substantially equal to the height of the race course portion supports 320. In the preferred embodiment, the distance between the interior side 211 and the hinges 400 is 11".

Figure 7:
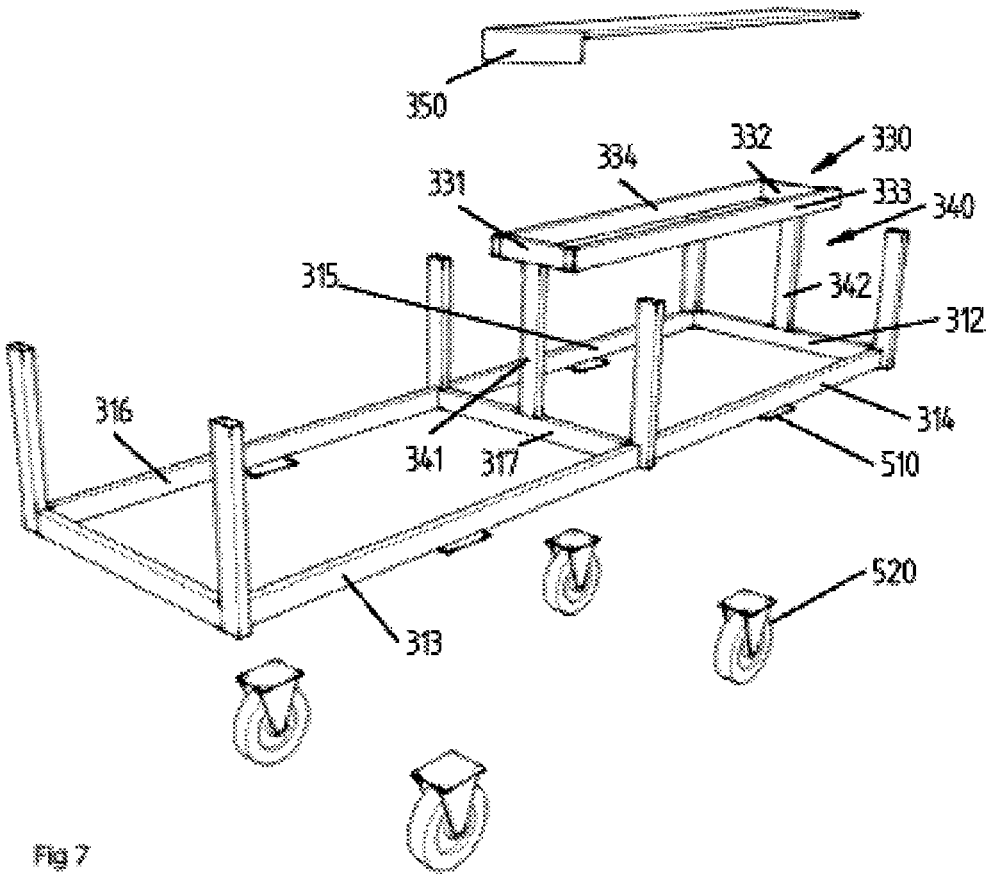
FIG. 7 is an elevated view of the base support according to an exemplary embodiment of the present invention.

The interior guard supports 340 elevate the interior guard frame 330 to a desirable height. The interior guard supports 340 engage the base support frame 310 substantially perpendicular to the horizontal plane of the base support frame 310. The base support 300 can have any number of interior guard supports 340. As shown in FIG. 7, in the preferred embodiment, two interior guard supports 340 engage the base support frame 310. In this embodiment, interior guard support 341 is positioned at the substantial median point of brace member 317 and the interior guard support 342 is positioned at the substantial median point of end member 312. The interior guard supports 340 can be any height that allows the interior guard frame 330 to be elevated. In the preferred embodiment, the interior guard supports 340 have a height of 15".

In another embodiment, the base support 300 can have an adjustable system (not shown) that allows the race course portion 110 to be positioned to a desirable height. In one embodiment, the plurality of race course portion supports 320 and the plurality of interior guard supports 340 can have an adjustable system that allows the race course portion 210 to be positioned to a desirable height. The adjustable system can be any means for extending the length of a member, for example, a telescoping means, or the like. The adjustable system has a locking mechanism that allows the length of the race course portion supports 320 or interior guard supports 340 to be locked at a desirable height.

In the preferred embodiment, the interior guard frame 330 secures the race course portion 210 in a substantially horizontal plane by preventing the race course portion 210 from rotating along an axis running the length of the race course portion 210. The interior guard frame 330 can have end member 331, end member 332, side member 333, and side member 334. In the preferred embodiment, the end member 331 engages interior guard support 341 and end member 332 engages the interior guard support 342. In the preferred embodiment, one race course portion 210 rests on three race course portion supports 320 along a horizontal line substantially off-center from the axial horizontal line of the race course portion 210 where the distance from the off-center horizontal line to the exterior frame member 232 is greater than the distance from the off-center horizontal line to the interior frame member 231. Said positioning causes the interior side 211 of race course portion 210 to rotate upwardly toward the interior guard frame 330, thereby allowing the interior guard frame 330 to secure the race course portion 210 in a substantially horizontal plane.

In another embodiment, the race course portion 210 can temporarily engage with the interior guard support 340 by any means of connecting two members. In this embodiment, the race course portion 210 can engage with the race course portion supports 320 along any line running the length of the race course portion 210.

In the preferred embodiment, the race course section 200 can also have an interior guard 350. The interior guard 350 is a surface designed and configured to provide for an inside boundary 240 to the race course 110. The interior guard 350 is also designed and configured to absorb the impact of vehicles or objects traveling within the perimeter of the race course 110. The interior guard 350 can be a cushion or cover that encompasses the interior guard frame 330. As shown in FIG. 7, the interior guard 350 is preferably shaped as a rectangle ending in a half circle, but could take any other shape, such as an oval, rectangle, hexagon, or the like. The interior guard 350 may comprise any supportive material, for example, without limitation, wood, metal, plastic, fabric, or the like. In one embodiment, the interior guard frame 330 provides support for the interior guard 350.

Figure 8:
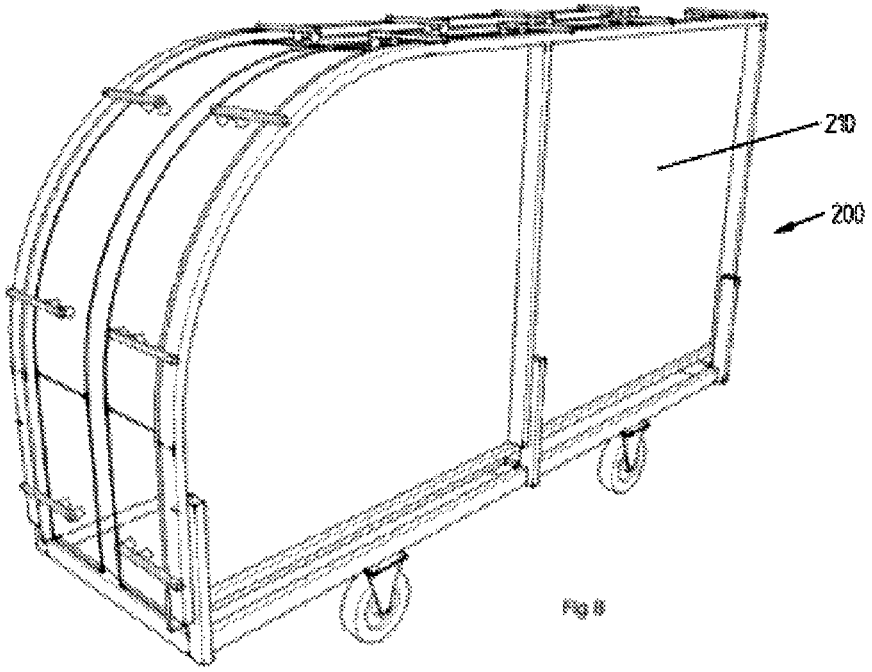
FIG. 8 is an elevated view of the race course section according to an exemplary embodiment of the present invention.
Figure 9:
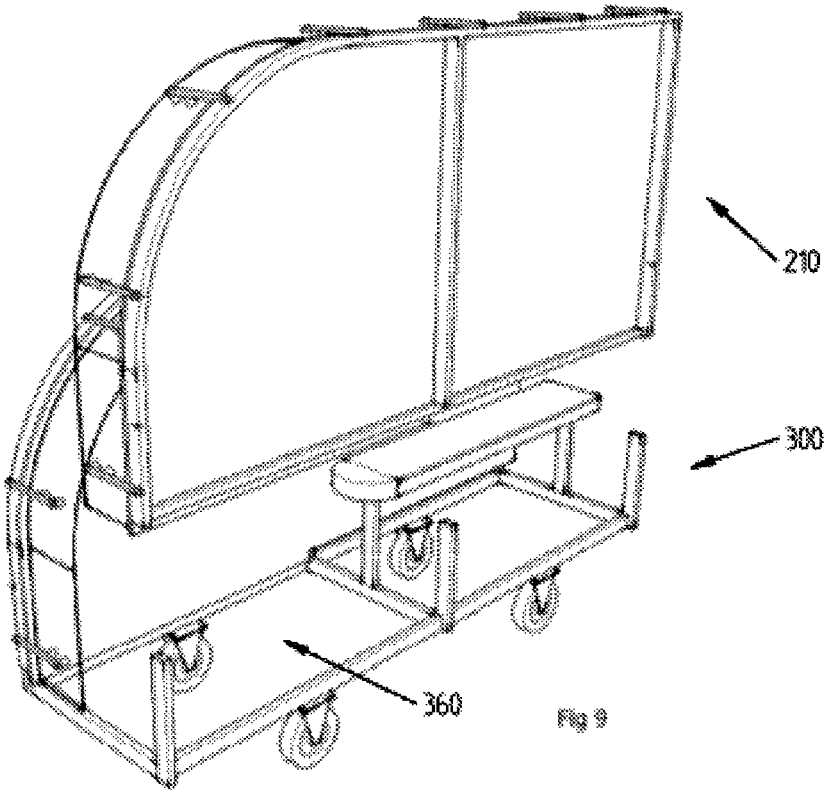
FIG. 9 is an elevated view of the race course section according to an exemplary embodiment of the present invention.

In the preferred embodiment, in addition to elevating the race course portion 210, the base support 300 allows the race course portions 210 to be vertically stowed. The positioning of the base support 300 members can be any positioning that allows for the race course portions 210 to be vertically stowed. In the preferred embodiment, the positioning of the race course portion supports 320 creates a race course portion cavity 360 where the race course portions 210 are stowed vertically inside the race course portion cavity. For example, without limitation, race course portion supports 323, 324, 325 and interior guard supports 341, 342 create race course portion cavity 360. As shown in FIG. 8, in the preferred embodiment, the width of the race course portion cavity, or the distance between the race course portion support 328 and race course portion support 323, is slightly greater than twice the distance between the bottom surface of the race surface frame 230 and the ridge 247 of the exterior guard 241 thereby allowing two race course portions 210 to be vertically stowed in the base support 300 for convenient storage. In another embodiment, where the race course portions 210 lack a boundary 240, the width of the race course portion cavity 360, or the distance between the race course portion support 328 and race course portion support 323, is slightly greater than twice the distance between the bottom surface of the race surface frame 230 and the surface 220 thereby allowing two race course portions 210 to be vertically stowed in the base support 300.

In another embodiment, the base support 300 allows four race course portions 210 to be vertically stowed. In this embodiment, the base support 300 has twelve race course portion supports 210 and four race course portion cavities 360, including two exterior race course portion cavities 360 and two interior race course portion cavities 360. In this embodiment, one exterior race course portion cavity 360 is rotationally engaged to race course portion support 325 and the other exterior race course portion cavity 360 is rotationally engaged to race course portion support 326 thereby allowing both exterior race course portion cavities 360 to rotate around the race course portion supports 325, 326, respectively, so that one exterior race course portion cavity 360 is in line with one of the interior race course portion cavity 360, and the other exterior race course portion cavity 360 is in line with the other interior race course portion cavity 360.

In the preferred embodiment, the race course portions 210 are permanently rotationally engaged to the race course portion supports 320 via a hinge 400 where the race course portions 210 are rotationally engaged to the race course portion supports 320 in the substantially vertically stowed position and in the substantially horizontal position. In another embodiment, the race course portions 210 can be rotationally engaged to the race course portion supports 320 when positioned substantially horizontal where the race course portions 210 are not rotationally engaged to the race course portion supports 320 when race course portions 210 are substantially vertically stowed in the base support 300.

In the preferred embodiment, the race course system 100 can have a plurality of portable members 500 that allow the race course system 100 to travel along the ground. The portable member 500 can be attached to the base support 300 at any location that allows for the race course system 100 to travel along the ground. In the preferred embodiment, the portable member 500 can have a mounting plate 510 and a caster 520. The mounting plate 510 is designed and configured to mount the caster 520 to the base support 300. In the preferred embodiment, one mounting plate 510 is positioned at the median position of side member 313, 314, 315, and 316. The mounting plate 510 is preferably shaped as a rectangular, thin plate, but could take any other shape, such as an oval, circular, hexagonal, or the like. The mounting plate 510 can comprise any hard supportive material, for example, without limitation, wood, metal, plastic, or the like.

The caster 520 is a wheel assembly designed and configured to allow the race course system 100 to travel along the ground. In the preferred embodiment, the caster 520 is connected to the mounting plate 510. The wheel diameter can be any length that allows for the travel of the race course system 100. In the preferred embodiment, the wheel diameter is 8".

In one embodiment, the race course system 100 can have at least one strut mechanism (not shown) for biasing a race course portion 210 between a substantially vertical and substantially horizontal position. One end of the strut mechanism engages the base support 300 and the other end of the strut mechanism engages the race surface frame 230. The race course system 100 can have a plurality of strut mechanisms that engage the base support 300 and the race surface frame 230. In the preferred embodiment, one end of the strut mechanism engages race course portion supports 324 while the other end of the strut mechanism engages the portion of the exterior frame 232 parallel to the interior frame member 231. The strut mechanism reduces the force required by the user to transition the race course portion from the vertical position to the horizontal portion by exerting an upward force on the portion of the exterior frame 232 parallel to interior frame member 231.

In one embodiment, the race course system 100 can have at least one console (not shown) for operating scale vehicles. The race course system 100 supports the console thereby allowing the operator to operate the scale vehicles without supporting the console. While the console can engage any position of the race course portion 210, the console preferable engages the portion of the exterior frame 232 parallel to the interior frame member 231 between two guard supports 243.

The race course system can be operated by providing a race course section 200 having a race course portion 210, a base support 300, a hinge 400, and a portable member 500, unfolding the race course portion 210 from the base support 300 thereby allowing the race course portion 210 to rotate around the hinge 400 and resting in a substantially horizontal plane, attaching a first race course portion 210 to a second race course portion 210 using an attachment member 250, attaching a first race course section 200 to a second race course section 200 using an attachment member 250, and operating scale vehicles on the race course system 100.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

I claim:

1. A race course system comprising a race course section having:

a race course portion comprising a first race course portion and a second race course portion, a base support comprising a cavity having a first race course portion cavity and a second race course portion cavity, a hinge, and a portable member, wherein the first race course portion cavity is capable of receiving the first race course portion, the second face course portion cavity is capable of receiving the second race course portion, the race course portion engages the base support by way of the hinge, and the base support engages the portable member.

2. The race course system of claim 1 wherein the race course portion comprises:

a surface, a race surface frame, and a boundary, wherein the boundary engages the race surface frame and the surface engages the race surface frame.

3. The race course system of claim 2 wherein the race surface frame comprises an interior frame member, exterior frame member, end frame member, and brace frame member.

4. The race course system of claim 2 wherein the boundary comprises an exterior guard and a guard support, wherein the exterior guard engages the guard support.

5. The race course system of claim 4 wherein the guard support comprises an absorption member.

6. The race course system of claim 1 wherein the base support comprises base support frame, a race course portion support, an interior guard frame, an interior guard support, and a cavity, wherein the base support frame engages the race course portion support, the interior guard supports engage the base support frame and the interior guard frame, and the cavity allows the race course portion to be stowed.

7. The race course system of claim 1 wherein the base support comprises an adjustable system.

8. The race course system of claim 1 wherein the portable member comprises a mounting plate and a caster.

9. The race course system of claim 1 wherein the race course section comprises an interior guard.

10. The race course system of claim 1 further comprising an attachment member.

11. The race course system of claim 1 further comprising a strut mechanism.

12. The race course system of claim 1 further comprising a console.

13. A method of operating a race course system comprising the steps of:

providing a race course section comprising a first race course portion and a second race course portion, a base support comprising a cavity having a first race course portion cavity and a second race course portion cavity, a hinge, and a portable member, rotating the race course portion around the hinge thereby allowing the race course portion to rest in a substantially horizontal plane, and rotating the race course portion around the hinge thereby allowing the first race course portion cavity to receive the first race course portion and the second race course portion cavity to receive the second race course portion.

14. A method of claim 13 further comprising the step of attaching the first race course portion to the second race course portion using an attachment member.

15. A method of claim 13 further comprising the step of attaching a first race course section to a second race course section using an attachment member.

* * * * *